US011234569B2

(12) United States Patent
Choi et al.

(10) Patent No.: US 11,234,569 B2
(45) Date of Patent: Feb. 1, 2022

(54) DUST CONTAINER AND CLEANER INCLUDING THE SAME

(71) Applicant: Samsung Electronics Co., Ltd., Suwon-si (KR)

(72) Inventors: In Gyu Choi, Suwon-si (KR); Yun Soo Jang, Suwon-si (KR); Jung Gyun Han, Suwon-si (KR); See Hyun Kim, Suwon-si (KR); Do Kyung Lee, Suwon-si (KR); Seung Ryong Cha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 60 days.

(21) Appl. No.: 16/727,122

(22) Filed: Dec. 26, 2019

(65) Prior Publication Data

US 2020/0205627 A1 Jul. 2, 2020

(30) Foreign Application Priority Data

Dec. 26, 2018 (KR) ..... 10-2018-0169577

(51) Int. Cl.
*A47L 9/16* (2006.01)
*A47L 9/10* (2006.01)
*A47L 9/04* (2006.01)

(52) U.S. Cl.
CPC ..... *A47L 9/1683* (2013.01); *A47L 9/0477* (2013.01); *A47L 9/102* (2013.01); *A47L 9/106* (2013.01);

(Continued)

(58) Field of Classification Search
CPC combination set(s) only.
See application file for complete search history.

(56) References Cited

U.S. PATENT DOCUMENTS 5,135,552 A * 8/1992 Weistra ..... A47L 9/1418 55/337
5,779,745 A * 7/1998 Kilstrom ..... A47L 9/1427 15/350

(Continued)

FOREIGN PATENT DOCUMENTS

CN 204105894 U 1/2015
DE 102005026692 A1 * 6/2006 ..... A47L 9/102

(Continued)

OTHER PUBLICATIONS

International Search Report in connection with International Application No. PCT/KR2019/018418 dated Apr. 29, 2020, 3 pages.

(Continued)

*Primary Examiner* — Joseph J Hail
*Assistant Examiner* — Jonathan R Zaworski

(57) ABSTRACT

A dust container capable of improving dust separation efficiency and preventing a suction force from being lowered, and a cleaner including the same. The cleaner includes: a main body including a suction portion to suck dust; and a dust container detachably installed in the main body to separate and store dust from the air sucked through the suction portion. The dust container includes: an inlet through which the air sucked through the suction portion; a collision wall facing the inlet, wherein dust introduced through the inlet collides with the collision wall; a first dust collecting wall to collect a part of the dust introduced through the inlet, the first dust collecting wall intersecting the collision wall; and a second dust collecting wall to collect a part of the dust introduced through the inlet, the second dust collecting wall intersecting the collision wall and the first dust collecting wall.

19 Claims, 8 Drawing Sheets

(52) U.S. Cl.
CPC ..... *A47L 9/165* (2013.01); *A47L 9/1608* (2013.01); *A47L 9/1616* (2013.01); *A47L 9/1666* (2013.01); *A47L 2201/00* (2013.01)

(56) References Cited

U.S. PATENT DOCUMENTS

| | | | | |
|---|---|---|---|---|
| 6,934,994 | B2 * | 8/2005 | Oh | A47L 9/1463 15/328 |
| 7,381,234 | B2 * | 6/2008 | Oh | A47L 9/1666 55/318 |
| 7,637,973 | B2 * | 12/2009 | Oh | A47L 9/00 15/328 |
| 7,749,294 | B2 * | 7/2010 | Oh | A47L 5/28 55/356 |
| 10,433,698 | B2 * | 10/2019 | Conrad | A47L 5/24 |
| 10,456,002 | B2 * | 10/2019 | Amaral | A47L 9/102 |
| 2002/0134238 | A1 * | 9/2002 | Conrad | B03C 3/017 95/79 |
| 2003/0106182 | A1 | 6/2003 | Lee | |
| 2007/0095030 | A1 * | 5/2007 | Oh | B04C 5/26 55/345 |
| 2007/0130895 | A1 | 6/2007 | Boeck et al. | |
| 2007/0289264 | A1 | 12/2007 | Oh | |
| 2008/0201895 | A1 * | 8/2008 | Kim | A47L 9/106 15/319 |
| 2008/0235899 | A1 * | 10/2008 | Haan | F04D 25/082 15/320 |

FOREIGN PATENT DOCUMENTS

| | | | | |
|---|---|---|---|---|
| DE | 202006016366 | U1 | 2/2007 | |
| DE | 102013104255 | A1 * | 10/2014 | A47L 9/1683 |
| JP | 2003-190061 | A | 7/2003 | |
| KR | 20-0331097 | Y1 | 10/2003 | |
| KR | 20060037666 | A * | 5/2006 | |
| KR | 10-0628088 | B1 | 9/2006 | |
| KR | 10-0778123 | B1 | 11/2007 | |
| KR | 100849554 | B1 * | 7/2008 | |
| KR | 10-2009-0084476 | A | 8/2009 | |
| KR | 10-1108048 | B1 | 1/2012 | |

OTHER PUBLICATIONS

Supplementary European Search Report dated Dec. 8, 2021, in connection with European Application No. 19905049.3, 6 pages.

* cited by examiner

DUST CONTAINER AND CLEANER INCLUDING THE SAME

CROSS-REFERENCE TO RELATED APPLICATIONS

This application is based on and claims priority under 35 U.S.C. § 119 to Korean Patent Application No. 10-2018-00169577, filed on Dec. 26, 2018, in the Korean Intellectual Property Office, the disclosure of which is incorporated by reference herein in its entirety.

BACKGROUND

1. Field

The disclosure relates to a dust container and a cleaner including the same, and more particularly, to a dust container for preventing a suction force from being lowered and a cleaner including the same.

2. Description of Related Art

In general, a cleaner is a home appliance that sucks air containing foreign substances such as dust by using a suction force generated by a motor installed in a main body, separates the foreign substances contained in the air by a dust separator, and then discharges the air from which the foreign substances have been removed to the outside.

In recent years, a robot cleaner that cleans a cleaning space by sucking foreign substances such as dust on a floor while automatically traveling the cleaning space without a user's control is a consumer's preferred trend.

A cleaner such as a robot cleaner includes a main body in which a motor is installed, and a dust container detachably coupled to the main body.

The dust container includes an inlet through which air and dust enter, a grille portion including a plurality of holes to filter out at least a part of the dust contained in the air introduced through the inlet, and an outlet through which air passed through the grille portion is discharged to the outside of the dust container.

Foreign substances such as dust may be accumulated in the grille portion due to the suction force of the motor. When the plurality of holes of the grille portion is clogged by foreign substances such as dust, the suction force of the cleaner may be significantly lowered.

SUMMARY

It is an aspect of the disclosure to provide a dust container capable of preventing a suction force from being lowered and a cleaner including the same.

It is another aspect of the disclosure to provide a dust container capable of improving dust separation efficiency and a cleaner including the same.

Additional aspects of the disclosure will be set forth in part in the description which follows and, in part, will be obvious from the description, or may be learned by practice of the disclosure.

In accordance with an aspect of the disclosure, a cleaner includes: a main body including a suction portion configured to suck dust; and a dust container detachably installed in the main body, and configured to separate and store dust from air sucked through the suction portion, wherein the dust container includes: an inlet through which the air sucked through the suction portion is introduced; a collision wall facing the inlet, wherein dust introduced through the inlet collides with the collision wall; a first dust collecting wall configured to collect at least a part of the dust introduced through the inlet, the first dust collecting wall intersecting the collision wall; and a second dust collecting wall configured to collect at least a part of the dust introduced through the inlet, the second dust collecting wall intersecting the collision wall and the first dust collecting wall.

A distance between e inlet and the collision wall may be shorter than a distance between outer walls of the dust container, the outer walls being opposite to each other.

When one surface of the collision wall facing the inlet is a front surface of the collision wall, the first dust collecting wall may be connected to a side edge of the collision wall, and the second dust collecting wall may be connected to a top of the collision wall.

The first dust collecting wall may include a plurality of first holes penetrating the first dust collecting wall.

The second dust collecting wall may include a plurality of second holes penetrating the second dust collecting wall.

At least one of the first dust collecting wall and the second dust collecting wall may further include a bypass passage configured to allow air to pass therethrough when the plurality of first holes and the plurality of second holes are clogged.

The bypass passage may be at least one of a predetermined gap formed between the first dust collecting wall and a structure being adjacent to the first dust collecting wall; and a predetermined gap formed between the second dust collecting wall and a structure being adjacent to the second dust collecting wall.

The second dust collecting wall may include a blocking portion which is a predetermined region being adjacent to the top of the collision wall and the blocking portion may be configured to prevent air and dust from passing through.

The cleaner may further include a first chamber positioned to one side of the collision wall, wherein dust fallen by collision with the collision wall and dust filtered by the first dust collecting wall and the second dust collecting wall are stored in the first chamber.

The cleaner may further include a second chamber positioned to the other side of the collision wall, wherein dust separated from the air passed through the first dust collecting wall and the second dust collecting wall is stored in the second chamber.

The dust container may further include a partition wall separating the first chamber from the second chamber, and the partition wall may be connected to one edge of the collision wall.

The dust container may further include a cyclone unit configured to separate dust from air passed through the first dust collecting wall or the second dust collecting wall.

The dust container may further include a multi cyclone unit configured to separate dust from air passed through the first dust collecting wall or the second dust collecting wall.

The dust container may further include a guide passage configured to guide air inside the dust container to a cyclone inlet of the cyclone unit, and the collision wall may form one surface of the guide passage.

A distance between the inlet and the collision wall may be shorter than 0.8 times a length of the dust container in a direction intersecting the collision wall.

The dust container may further include an outlet configured to discharge air inside the dust container to an outside of the dust container, and the outlet may be formed in one of a side and a bottom of the dust container.

In accordance with another aspect of the disclosure, a dust container detachably coupled to a main body of a cleaner includes: a collision wall facing an inlet through which air is introduced into the dust container, and positioned closer to the inlet than an outer wall of the dust container; a dust collecting wall intersecting the collision wall, and configured to collect at least a part of dust introduced through the inlet, the dust collecting wall including a plurality of holes; and a bypass passage formed between the dust collecting wall and a structure being adjacent to the dust collecting wall, and configured to prevent a suction force of the cleaner from being lowered by clogging of the plurality of holes.

The dust collecting wall may include: a first dust collecting wall configured to collect at least a part of the dust introduced through the inlet, the first dust collecting wall intersecting the collision wall; and a second dust collecting wall configured to collect at least a part of the dust introduced through the inlet, the second dust collecting wall intersecting the collision wall and the first dust collecting wall.

The bypass passage may be at least one of: a predetermined gap formed between the first dust collecting wall and a structure being adjacent to the first dust collecting wall; and a predetermined gap formed between the second dust collecting wall and a structure being adjacent to the second dust collecting wall.

When one surface of the collision wall facing the inlet is a front surface of the collision wall, the first dust collecting wall may be connected to a side edge of the collision wall, and the second dust collecting wall may be connected to a top of the collision wall.

In accordance with another aspect of the disclosure, a cleaner includes: a main body including a wheel rotating on a rotation shaft extending in a first direction; a brush device positioned in the main body, and configured to suck air containing dust; and a dust container configured to separate and store dust from the air sucked through the brush device, wherein the dust container includes: an inlet through which air is introduced in a second direction intersecting the first direction; a collision wall facing the inlet, wherein a distance between the collision wall and the inlet is shorter than a length of the dust container in the second direction; a first dust collecting wall configured to collect at least a part of the dust introduced through the inlet, the first dust collecting wall intersecting the collision wall; and a second dust collecting wall configured to collect at least a part of the dust introduced through the inlet, the second dust collecting wall intersecting the collision wall and the first dust collecting wall.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

FIGS. 1 through 8, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

The terms used in the present specification are used to describe the embodiments of the present disclosure. Accordingly, it should be apparent to those skilled in the art that the following description of exemplary embodiments of the present invention is provided for illustration purpose only and not for the purpose of limiting or/or restricting the invention. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, components, or combination thereof, but do not preclude the presence or addition of one or more other features, figures, steps, components, members, or combinations thereof.

It will be understood that although the terms first, second, etc. may be used herein to describe various components, these components should not be limited by these terms, and the terms are only used to distinguish one component from another. For example, without departing from the scope of the present invention, the first component may be referred to as a second component, and similarly, the second component may also be referred to as a first component.

Hereinafter, embodiments according to the disclosure will be described in detail with reference to the accompanying drawings. Hereinafter, a robot cleaner will be described in detail as an example of a cleaner. A dust container of the disclosure may be applied to various types of cleaners as well as a robot cleaner.

Figure 1:
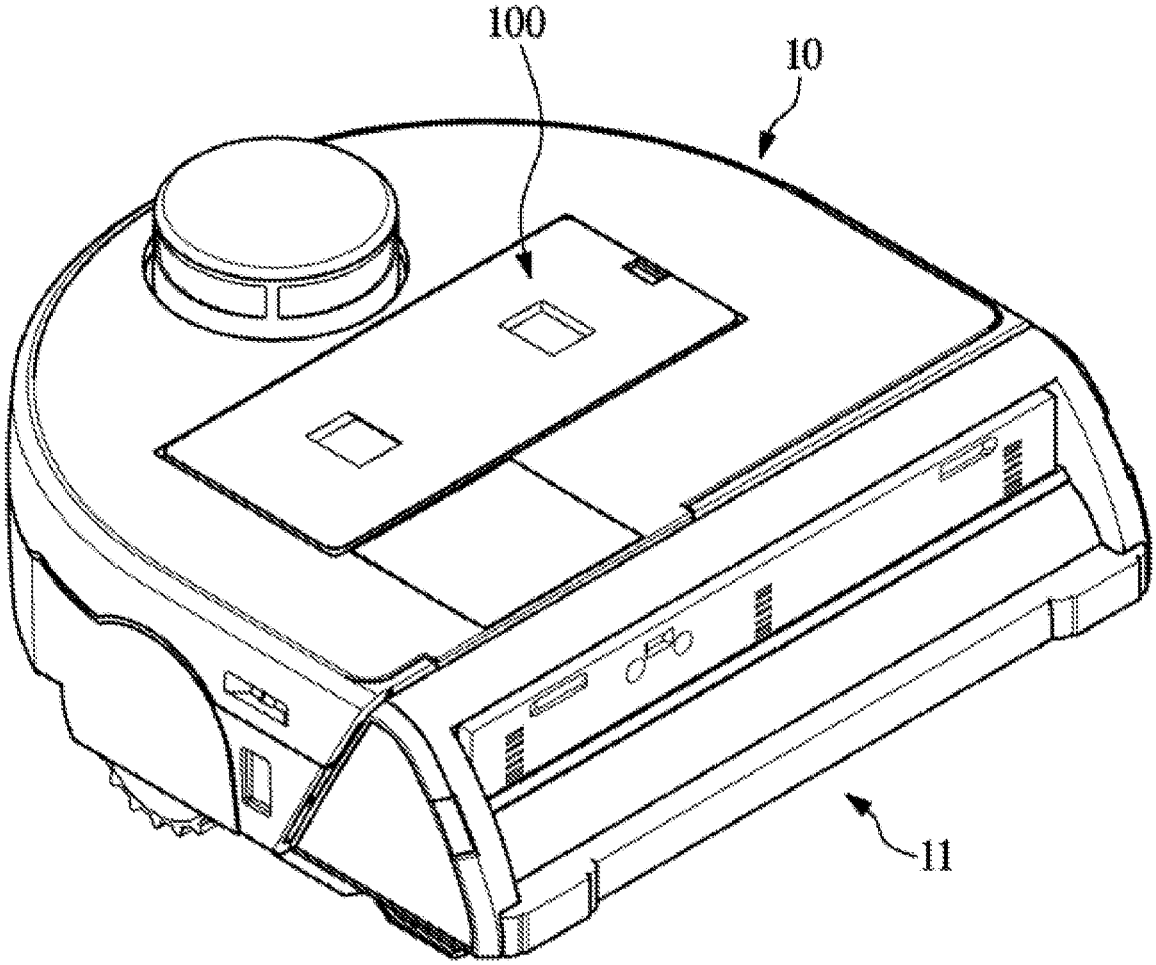
FIG. 1 illustrates a perspective view of a cleaner according to an embodiment of the disclosure.
Figure 2:
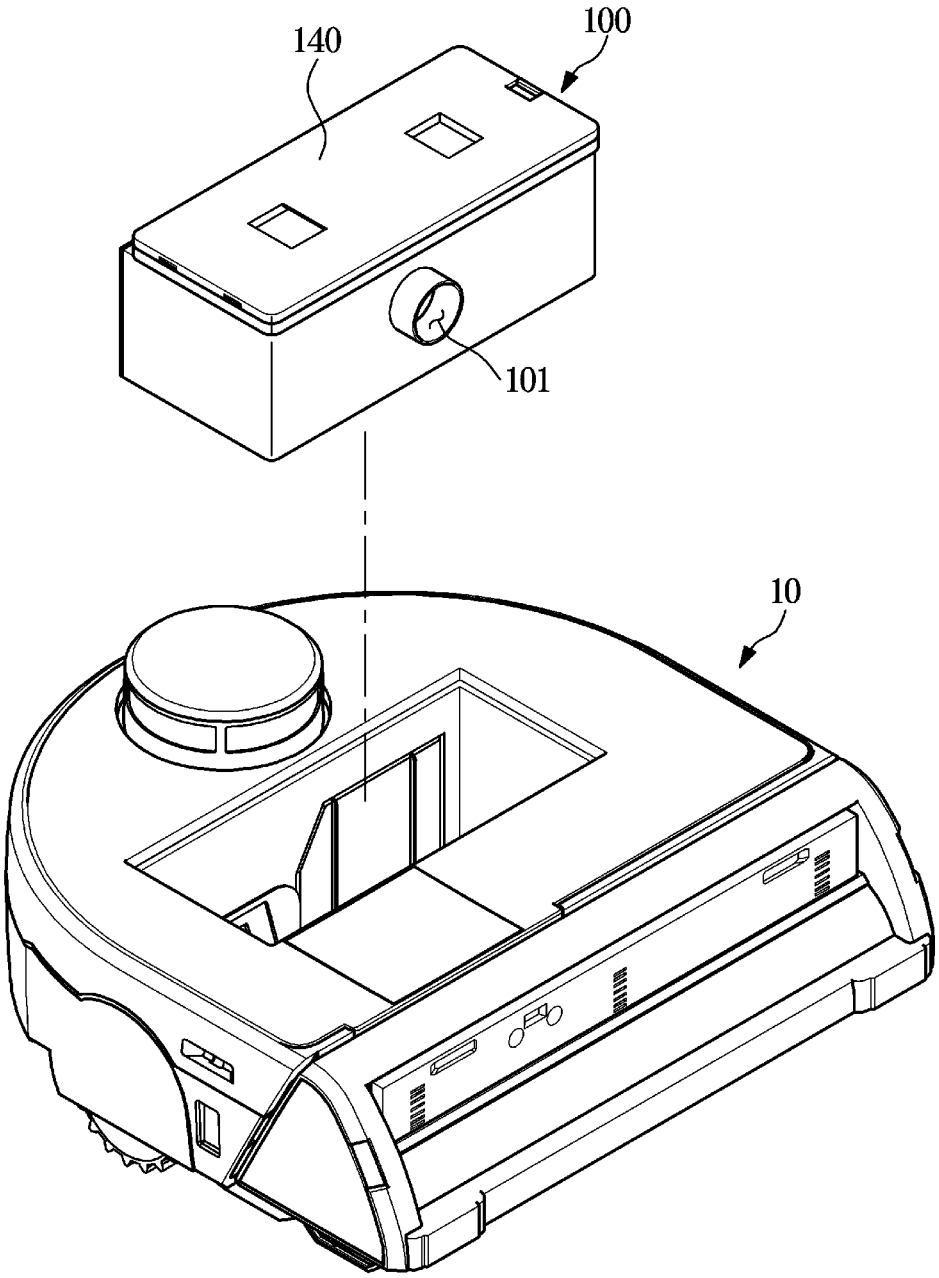
FIG. 2 illustrates a main body and a dust container separated from the main body in the cleaner according to an embodiment of the disclosure.

FIG. 1 illustrates a perspective view of a cleaner according to an embodiment of the disclosure, and FIG. 2 illustrates a main body and a dust container separated from the main body, in the cleaner according to an embodiment of the disclosure.

Referring to FIG. 1, the cleaner may include a main body 10 including a suction portion 11 to suck air and dust, and a dust container 100 coupled to the main body 10. The dust container 100 may be separated from the main body 10.

The cleaner may suck dust on a floor together with air while moving along the floor. Then, the cleaner may separate and store the dust contained in the sucked air, and discharge the air from which the dust is removed.

Referring to FIG. 2, the dust container 100 may separate and store dust. The dust container 100 may be detachably coupled to the main body 10 so that a user may remove dust inside the dust container 100.

Figure 3:
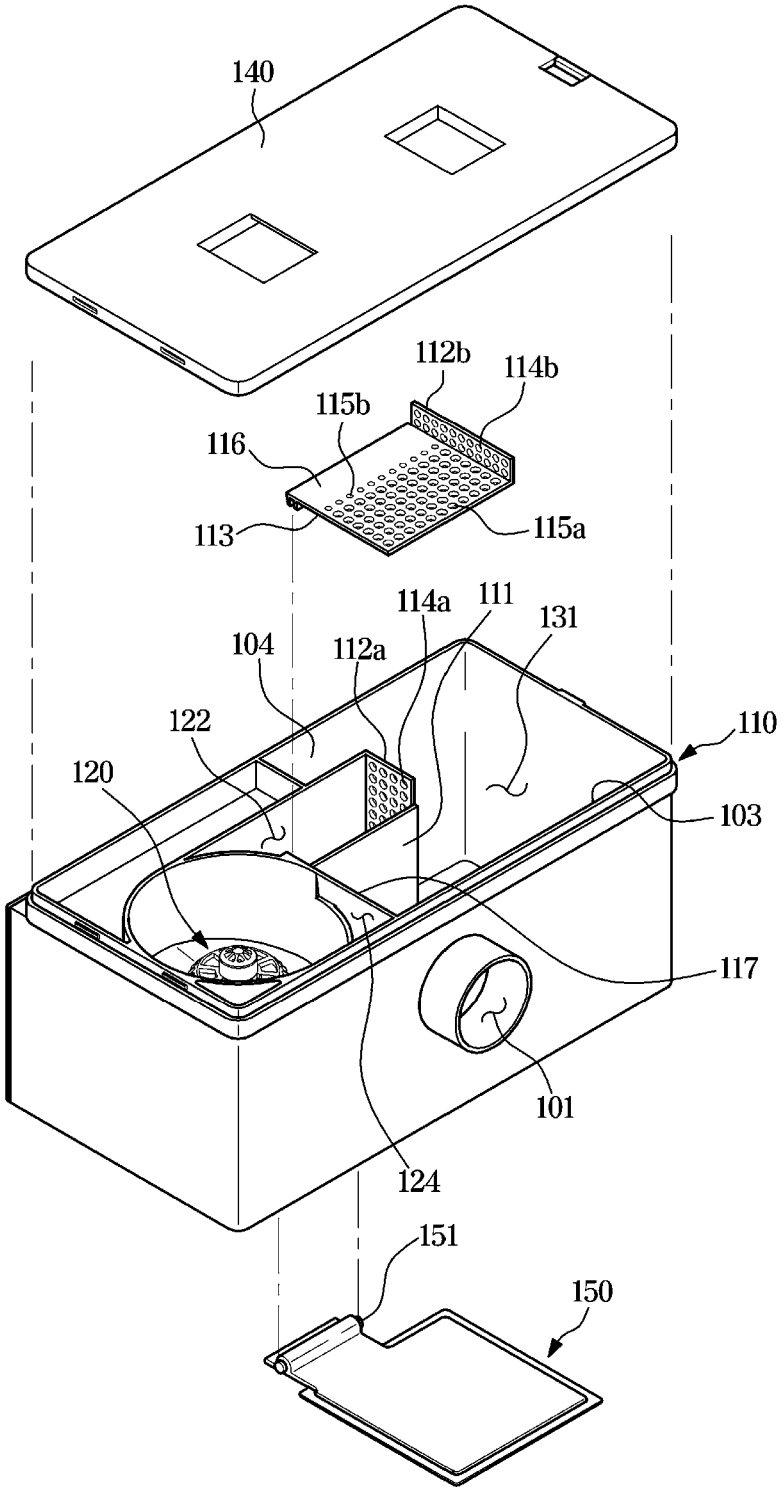
FIG. 3 illustrates an exploded perspective view of the dust container in the cleaner according to an embodiment of the disclosure.

FIG. 3 illustrates an exploded perspective view of the dust container 100 in the cleaner according to an embodiment of the disclosure.

Referring to FIG. 3, in the cleaner according to an embodiment of the disclosure, the dust container 100 may include a housing 110 for separating and storing dust, an upper cover 140 for covering an open, upper side of the housing 110, and a lower cover for covering an opening formed in a bottom of the housing 110.

The upper cover 140 may be detachably coupled to the housing 110. The user may separate the upper cover 140 from the housing 110 to discharge dust inside the housing 110 to an outside of the housing 110.

The lower cover 150 may be rotatably coupled to the housing 110. The lower cover 150 may include a shaft portion 151. The shaft portion 151 may be coupled to a shaft coupling portion 152 (see FIG. 8) positioned on the bottom of the housing 110. Instead, the lower cover 150 may be detachably coupled to the housing 110, like the upper cover 140.

The user may open the lower cover 150 to discharge dust stored in a first chamber 131 and a second chamber 132 to the outside of the housing 110.

The housing 110 may include an inlet 101 through which air is introduced into the housing 110, and an outlet 102 (see FIG. 4) through which air inside the housing 110 is discharged to the outside of the housing 110.

The housing 110 may include a collision wall 111 facing the inlet 101, a plurality of first dust collecting walls 112*a* and 112*b* intersecting the collision wall 111, and a second dust collecting wall 113 intersecting the collision wall 111 and the first dust collecting walls 112*a* and 112*b*. The first dust collecting walls 112*a* and 112*b* may include the collecting wall 112*a* and the collecting wall 112*b*.

As illustrated in FIG. 3, the collecting wall 112*b* and the second dust collecting wall 113 may be detachably coupled to the housing 110. However, the disclosure is not limited thereto, and the dust collecting wall 112*b* and the second dust collecting wall 113 may be integrated into the housing 110.

Each of the first dust collecting walls 112*a* and 112*b* may include a plurality of first holes 114*a* and 114*b*. The second dust collecting wall 113 may include a plurality of second holes 115*a* and 115*b* and a blocking portion 116, which will be described in detail later.

The dust container 100 may include a cyclone unit 120 positioned in one side of the housing 110 to separate dust. In FIG. 3, a single cyclone unit is shown, however, the cyclone unit 120 is not limited to this. That is, the dust container 100 may contain a multi cyclone unit.

Figure 4:
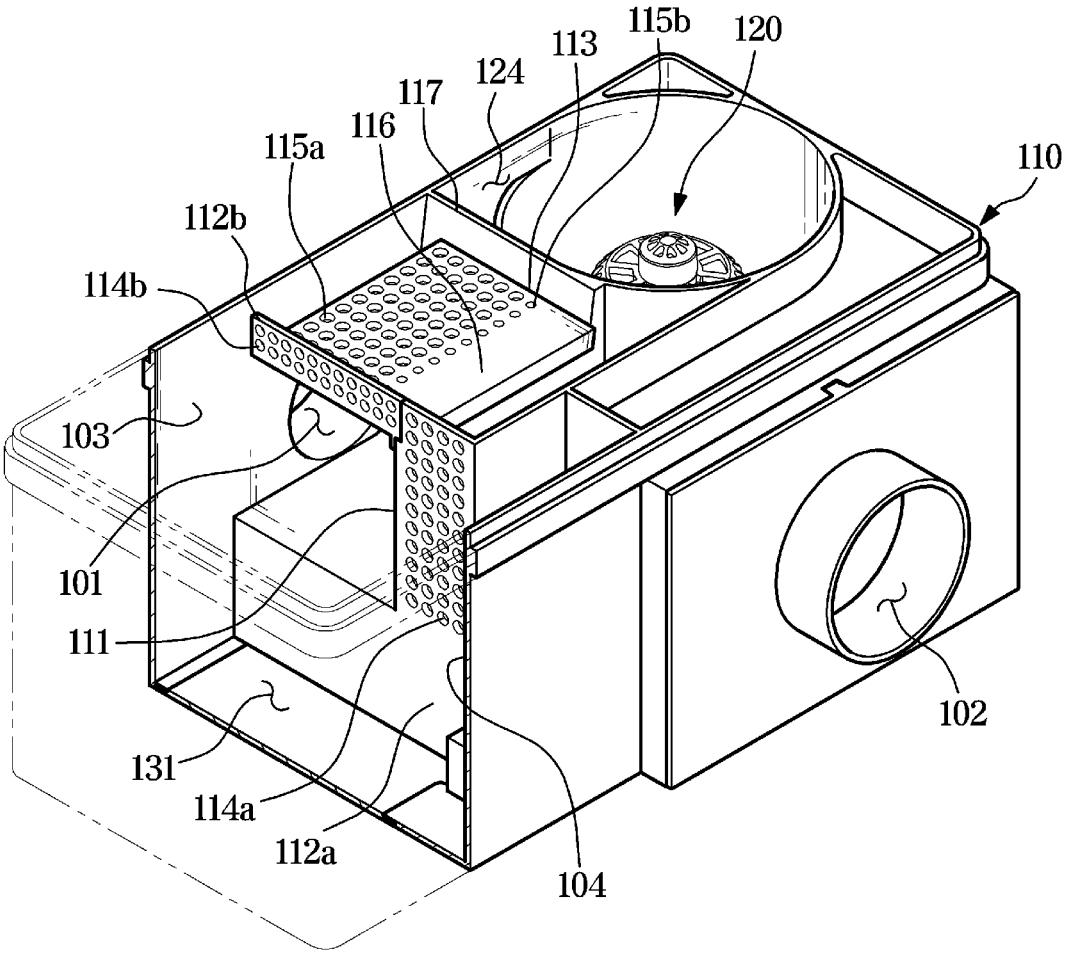
FIG. 4 illustrates a cross-sectional perspective view of the dust container in the cleaner according to an embodiment of the disclosure.

FIG. 4 illustrates a cross-sectional perspective view of the dust container 100 in the cleaner according t an embodiment of the disclosure.

Referring to FIG. 4, the housing 110 may include the collision wall 111 facing the inlet 101, wherein dust introduced through the inlet 101 collides with the collision wall 111.

The collision wall 111 may be positioned relatively close to the inlet 101. Specifically, a distance between the collision wall 111 and the inlet 101 may be shorter than a distance between opposite outer walls 103 and 104 of the housing 110. Through the arrangement, foreign substances introduced into the inlet 101 may collide with the collision wall 111 by a suction force and inertia to lose kinetic energy and fall by gravity. The foreign substances that have lost the kinetic energy due to the collision with the collision wall 111 may be stored in the first chamber 131 without moving to the first dust collecting walls 112*a* and 112*b* or the second dust collecting wall 113 which will be described later. The collision wall 111 may reduce kinetic energy of foreign substances having a relatively large volume and mass to store the foreign substances in the first chamber 131. Thereby, the dust separation efficiency of the dust container 100 may be improved. More specifically, the collision wall 111 may primarily separate foreign substances having a large volume or mass. The foreign substances collided with the collision wall 111 may be stored in the first chamber 131.

The dust container 100 may include the first dust collecting walls 112*a* and 112*b* and the second dust collecting wall 113. The dust collecting wall 112*a* may be connected to one side edge of the collision wall 111. The dust collecting wall 112*a* may be connected to one side edge of the collision wall 111 and intersect the collision wall 111. The dust collecting wall 112*a* may include the plurality of holes 114*a*. The plurality of holes 114*a* may penetrate the dust collecting wall 112*a*.

The second dust collecting wall 113 may be connected to a top of the collision wall 111. The second dust collecting wall 113 may intersect the collision wall 111. More specifically, the second dust collecting wall 113 may intersect the as the dust collecting wall 112*a* and the collision wall 111. One side edge of the second dust collecting wall 113 may be connected to the dust collecting wall 112*b*.

The dust collecting wall 112*b* may be integrated into the second dust collecting wall 113 or connected to one edge of the second dust collecting wall 113. Also, the dust collecting wall 112*b* may be connected to the dust collecting wall 112*a*.

The second dust collecting wall 113 may include the plurality of second holes 115*a* and 115*b*. The plurality of second holes (also referred to as holes) 115*b* being adjacent to the collision wall 111 may be smaller than the plurality of second holes (also referred to as holes) 115*a* being adjacent to the inlet 101. The second dust collecting wall 113 may also include the blocking portion 116 positioned in a predetermined region being adjacent to the collision wall 111. The blocking portion 116 may include no hole.

The housing 110 may include the outer walls 103 and 104. The outer walls 103 and 104 may form an outer appearance and an inner space of the housing 110.

The cyclone unit 120 may include a cyclone inlet 123 (refer to FIG. 6) through which air is introduced into the cyclone unit 120, and a cyclone outlet 124 for guiding dust separated from the air introduced into the cyclone unit 120 to the second chamber 132. Air introduced into the cyclone unit 120 may be discharged to an outside of the cyclone unit 120 and the housing 110 through a discharge portion positioned at a center of the cyclone unit 120.

Figure 5:
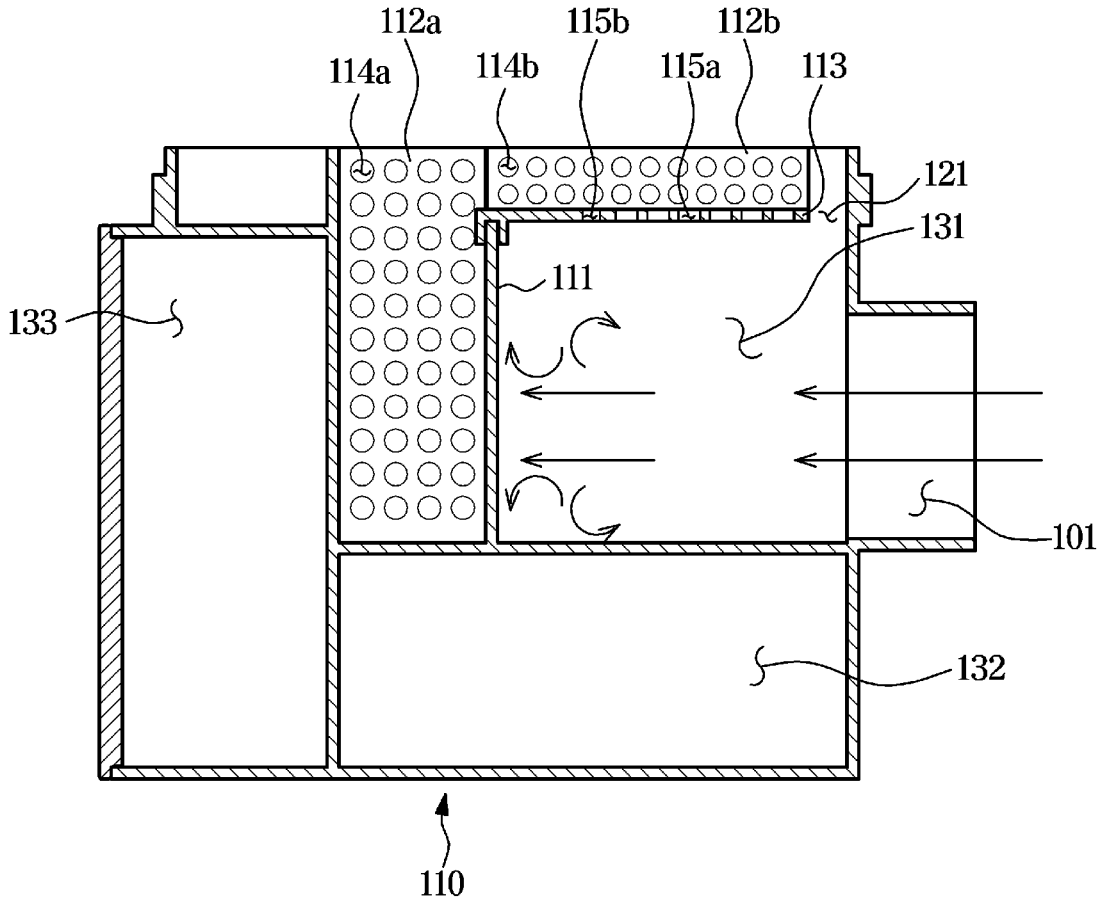
FIG. 5 illustrates a side cross-sectional view of the dust container in the cleaner according to an embodiment of the disclosure.
Figure 6:
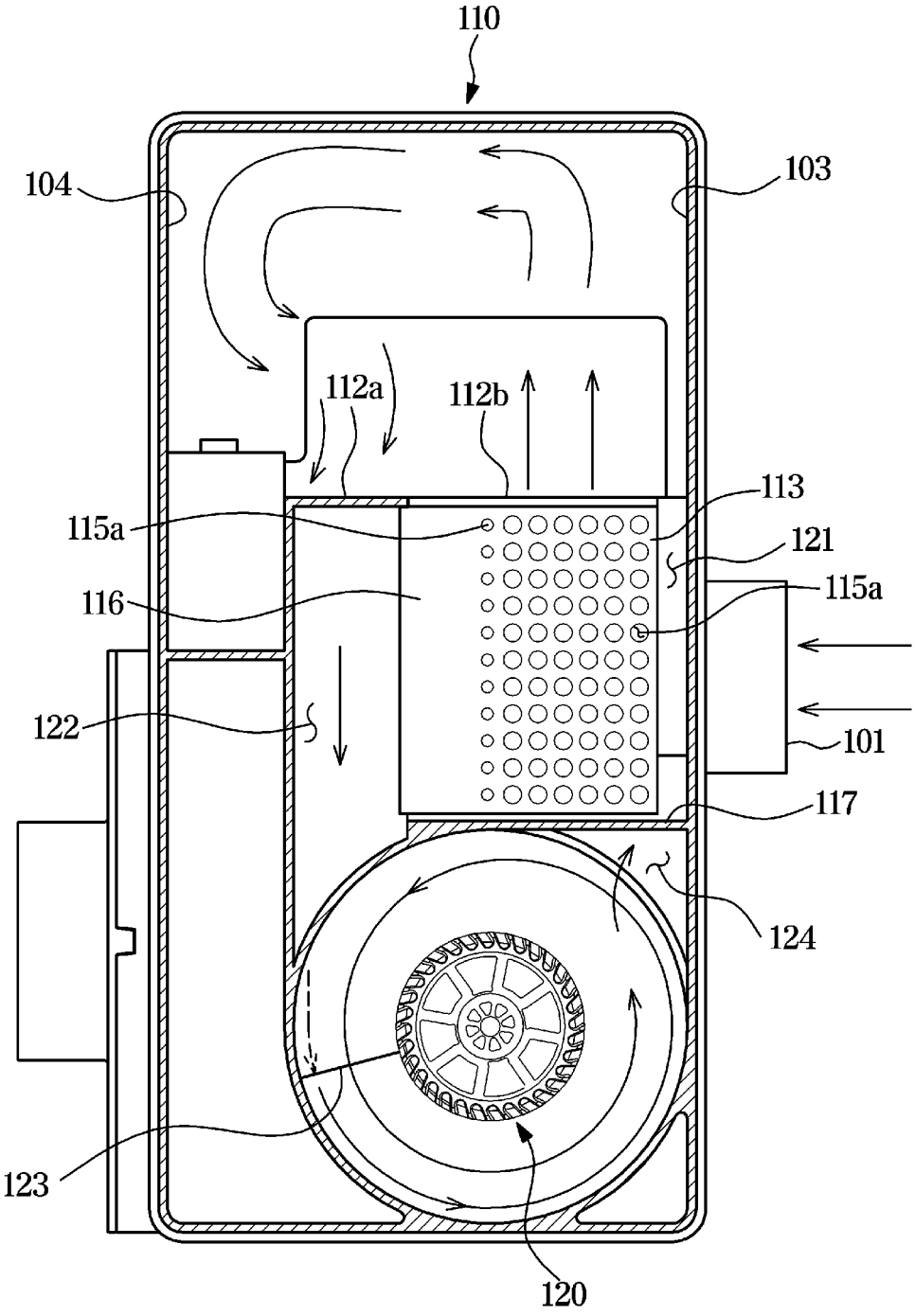
FIG. 6 illustrates a top view of the dust container in the cleaner according to an embodiment of the disclosure.
Figure 7:
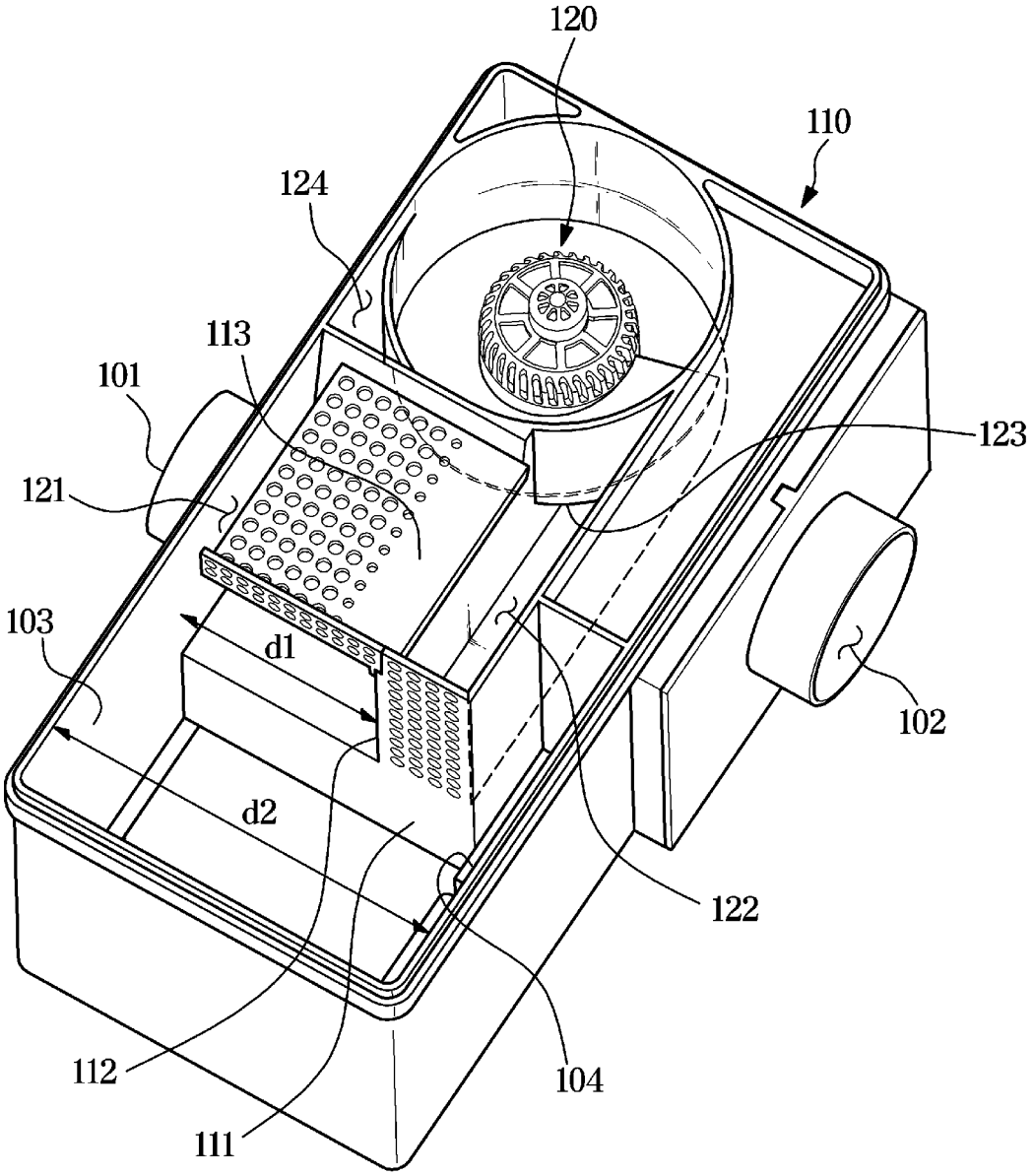
FIG. 7 illustrates a perspective view of the dust container in the cleaner according to an embodiment of the disclosure.

FIG. 5 illustrates a side cross-sectional view of the dust container 100 in the cleaner according to an embodiment of the disclosure, FIG. 6 illustrates a top view of the dust container 100 in the cleaner according to an embodiment of the disclosure, and FIG. 7 illustrates a perspective view of the dust container 100 in the cleaner according to an embodiment of the disclosure.

Hereinafter, flows of air and dust inside the dust container 100 according to an embodiment of the disclosure will be described in detail with reference to FIGS. 5 to 7.

As shown in FIG. 5 air and foreign substances introduced into the inlet 101 may first collide with the collision wall 111. As described above, foreign substances moving toward the collision wall 111 by inertia and a suction force may collide with the collision wall 111 to lose kinetic energy, and be stored in the first chamber 131.

Through the process, foreign substances having a relatively large volume or a relatively large mass may be first stored in the first chamber 131.

After colliding with the collision wall 111, the air and foreign substances may pass through the first dust collecting walls 112*a* and 112*b* or the second dust collecting wall 113, and then be introduced into the cyclone unit 120. Specifically, the air and foreign substances may pass through the plurality of first holes 114*a* and 114*b* of the first dust collecting walls 112*a* and 112*b* or the plurality of second holes 115*a* and 115*b* of the second dust collecting wall 113, and then be introduced into the cyclone unit 120.

When the foreign substances pass through the plurality of first holes 114*a* and 114*b* and the plurality of second holes 115*a* and 115*b*, a part of the foreign substances may fail to pass through the plurality of first holes 114*a* and 114*b* and the plurality of second holes 115*a* and 115*b*, and may clog the first and second holes 114*a*, 114*b*, 115*a*, and 115*b*. When a plurality of holes for filtering out foreign substances are clogged by foreign substances, a suction force of a cleaner is rapidly lowered.

According to an idea of the disclosure, the dust container 100 may prevent a suction force from being lowered, through a predetermined gap formed between the first dust collecting walls is 112*a* and 112*b* and a structure being adjacent to the first dust collecting walls 112*a* and 112*b* or between the second dust collecting wall 113, and a structure being adjacent to the second dust collecting wall 113.

According to an embodiment of the disclosure, the dust container 100 may include a bypass passage 121 formed between the second dust collecting wall 113 and the outer wall 103. The bypass passage 121 may be a predetermined gap formed between an end portion of the second dust collecting wall 113 and the outer wall 103.

As air and foreign substances are introduced into and discharged from the dust container 100, the plurality of holes 114*a*, 114*b*, 115*a*, and 115*b* of the first dust collecting walls 112*a* and 112*b* and the second dust collecting wall 113 may be clogged by the foreign substances. When clogging occurs, air does not move smoothly inside a dust container, resulting in a significant reduction of a suction force. According to an idea of the disclosure, the dust container 100 may include the bypass passage 121. When the plurality of first holes 114*a* and 114*b* of the first dust collecting walls 112*a* and 112*b* and the plurality of second holes 115*a* and 115*b* of the second dust collecting wall 113 are clogged, the bypass passage 121 may provide a flow passage through which air may move. The bypass passage 121 may prevent a significant reduction in suction force of the cleaner by allowing air to move even when the plurality of holes of the dust collecting walls are clogged.

Referring to FIG. 6, the dust container 100 according to an embodiment of the disclosure may include the blocking portion 116 and the plurality of holes 115*b* having a relatively small size.

The blocking portion 116 may be the predetermined region of the second dust collecting wall 113. The blocking portion 116 may be a region of the second dust collecting wall 113 being adjacent to the top of the collision wall 111. The blocking portion 116 may include none of the plurality of second holes 115*a* and 115*b* to prevent air and dust from passing therethrough.

According to an embodiment of the disclosure, the plurality of second holes 115*a* and 115*b* may include the holes 115*a* and the holes 115*b* having different sizes. A diameter of the holes 115*b* may be smaller than that of the holes 115*a*.

Because the diameter of the holes 115*b* is smaller than that of the holes 115*a*, foreign substances such as dust may have greater difficulties in passing through the holes 115*b* than the holes 115*a*.

According to an embodiment of the disclosure, because the second dust collecting wall 113 includes the blocking portion 116 and the plurality of holes 115*b*, air and foreign substances may be prevented from entering the cyclone unit 120 by moving upward immediately after colliding with the collision wall 111. Although a part of the foreign substances enters the cyclone unit 120 by passing through the holes 155*b* after colliding with the collision wall 111, an amount of foreign substances immediately entering the cyclone unit 120 may be reduced because the blocking portion 116 and the holes 115*b* having a relatively small diameter are provided. Thereby, foreign substances having a large size may be prevented from flowing into the cyclone unit 120, and the dust separation efficiency of the dust container 100 may be improved.

Referring to FIG. 5, air introduced into the inlet 101 of the dust container 100 may collide with the collision wall 111 and then circle inside the first chamber 131. As described above, at this time, a part of the foreign substances may be separated and stored in the first chamber 131.

Air and the remaining foreign substances may enter the cyclone unit 120 through the first dust collecting walls 112*a* and 112*b*, the second dust collecting wall 113, or the bypass passage 121. Air and foreign substances passed through the dust collecting wall 112*a* may enter the cyclone inlet 123 of the cyclone unit 120 along a guide passage 122.

The air and foreign substances introduced into the cyclone inlet 123 may form a turning airflow along the cyclone unit 120. Due to the turning airflow, foreign substances in the air may be introduced into the second chamber 132 through the cyclone outlet 124 provided at an upper side of the cyclone unit 120. Fine dust having a relatively small size and mass may be separated and stored in the second chamber 132 by the turning airflow. The air from which the fine dust has been removed may be introduced into a third chamber 133 through a center hole of the cyclone unit 120. The air introduced into the third chamber 133 may be discharged to the outside of the dust container 100 through the outlet 102.

The guide passage 122 may be formed by a predetermined wall inside the housing 110, the collision wall 111, and the upper cover 140. The guide passage 122 may guide air inside the dust container 100 to the cyclone unit 120. The collision wall 111 may form one surface of the guide passage 122. Specifically, the collision wall 111 may form a sidewall of the guide passage 122.

Referring to FIG. 7, according to an embodiment of the disclosure, a distance d1 between the inlet 101 and the collision wall 111 may be shorter than a distance d2 between the first outer wall 103 and the second outer wall 104 that are opposite to each other. Specifically, the distance d1 between the collision wall 111 and the first outer wall 103 in which the inlet 101 is positioned may be shorter than 0.8 times the distance d2 between the first outer wall 103 and the second outer wall 104. Through the structure, according to an idea of the disclosure, foreign substances introduced into the inlet 101 may collide with the collision wall 111, and the foreign substances collided with the collision wall 111 may lose kinetic energy to be separated and stored in the first chamber 131.

Figure 8:
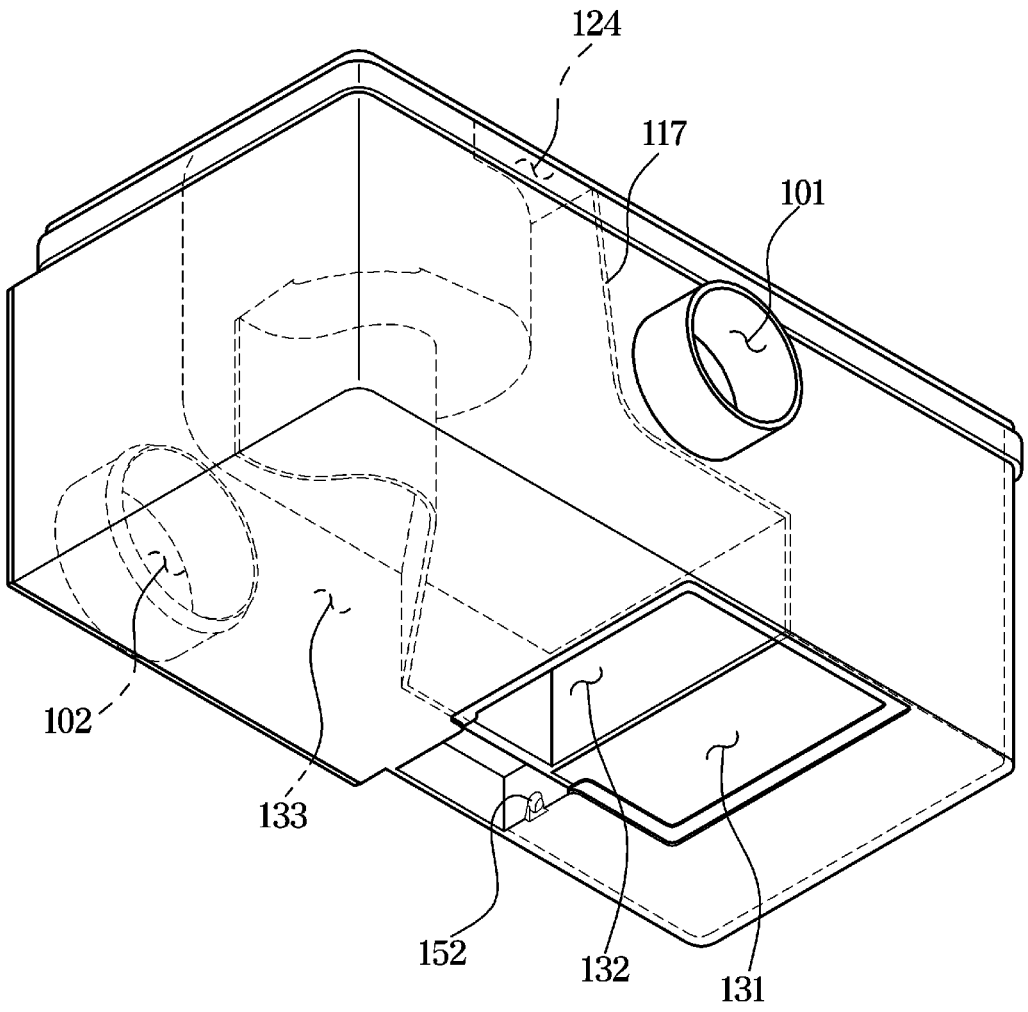
FIG. 8 illustrates a bottom view of the dust container in the cleaner according to an embodiment of the disclosure.

FIG. 8 illustrates a bottom view of the dust container 100 in the cleaner according to an embodiment of the disclosure.

Hereinafter, the first chamber 131, the second chamber 132, and the third chamber 133 of the disclosure will be described with reference to FIG. 8.

Referring to FIG. 8, the housing 110 according to an embodiment of the disclosure may include the first chamber 131, the second chamber 132, and the third chamber 133.

Dust introduced into the inlet 101 may be primarily separated and stored in the first chamber 131. The first chamber 131 and the second chamber 132 may be separated by a partition wall 117. The partition wall 117 may be connected to one edge of the collision wall 111, and may intersect the collision wall 111.

Foreign substances introduced into the cyclone outlet 124 by a turning airflow of the cyclone unit 120 may be separated and stored in the second chamber 132. In the second chamber 132, fine dust may be stored.

The turning airflow of the cyclone unit 120 may descend and flow into the third chamber 133 through the center hole of the cyclone unit 120. Air having relatively few foreign substances may be introduced into the third chamber 133, and may be discharged to the outside of the dust container 100 through the outlet 102 connected to the third chamber 133.

A predetermined filter may be provided in the inside of the cleaner or at the outlet of the cleaner. Ultrafine dust or the like, which is not filtered through the above-described process, may be filtered by the predetermined filter. Air passed through the predetermined filter may be discharged to the outside of the cleaner.

According to an embodiment of the disclosure, the outlet 102 may be provided in one side of the housing 110. However, the disclosure is not limited thereto, and the outlet 102 may be provided in the bottom of the housing 110.

As is apparent from the above, according to an aspect of the disclosure, there may be provided a dust container capable of preventing a suction force from being lowered and a cleaner including the same.

According to another idea of the disclosure, there may be provided a dust container capable of improving dust separation efficiency and a cleaner including the same.

While the disclosure has been particularly described with reference to exemplary embodiments, it should be understood by those of skilled in the art that various changes in form and details may be made without departing from the spirit and scope of the disclosure.

Although the present disclosure has been described with various embodiments, various changes and modifications may be suggested to one skilled in the art. It is intended that the present disclosure encompass such changes and modifications as fall within the scope of the appended claims.

What is claimed is:

1. A cleaner comprising:

a main body including a suction portion, the suction portion configured to suck air and dust; and a dust container detachably installed in the main body, the dust container configured to separate and store dust from air sucked through the suction portion, wherein the dust container comprises:

an outer wall including a front surface with an inlet through which the air and dust sucked through the suction portion is introduced to the dust container;

a collision wall parallel to the front surface with the inlet, wherein the dust introduced through the inlet collides with the collision wall;

a first dust collecting wall configured to collect at least a part of the dust introduced through the inlet, the first dust collecting wall perpendicular to the collision wall; and a second dust collecting wall extending from a top of the collision wall towards the front surface with the inlet and configured to collect at least a part of the dust introduced through the inlet, the second dust collecting wall perpendicular to the collision wall and the first dust collecting wall.

2. The cleaner according to claim 1, wherein a distance between the inlet and the collision wall is shorter than a distance between outer walls of the dust container, the outer walls being opposite to each other.

3. The cleaner according to claim 2, wherein the distance between the inlet and the collision wall is shorter than 0.8 times a length of the dust container in a direction intersecting the collision wall.

4. The cleaner according to claim 1, wherein, based on one surface of the collision wall facing the inlet being a front surface of the collision wall:

the first dust collecting wall is connected to a side edge of the collision wall; and the second dust collecting wall is connected to a top of the collision wall.

5. The cleaner according to claim 4, wherein:

the second dust collecting wall comprises a blocking portion, the blocking portion being a predetermined region adjacent to the top of the collision wall; and the blocking portion is configured to prevent air and dust from passing through the blocking portion.

6. The cleaner according to claim 1, wherein:

the first dust collecting wall comprises a plurality of first holes, the plurality of first holes penetrating the first dust collecting wall; and the second dust collecting wall comprises a plurality of second holes, the plurality of second holes penetrating the second dust collecting wall.

7. The cleaner according to claim 6, wherein at least one of the first dust collecting wall or the second dust collecting wall further comprises a bypass passage, the bypass passage configured to allow air to pass therethrough in response to the plurality of first holes and the plurality of second holes being clogged.

8. The cleaner according to claim 7, wherein the bypass passage includes at least one of:

a predetermined gap formed between the first dust collecting wall and a structure being adjacent to the first dust collecting wall; or a predetermined gap formed between the second dust collecting wall and a structure being adjacent to the second dust collecting wall.

9. The cleaner according to claim 1, further comprising a first chamber positioned to one side of the collision wall, wherein the first chamber stores:

dust fallen by collision with the collision wall, and dust filtered by the first dust collecting wall and the second dust collecting wall.

10. The cleaner according to claim 9, further comprising a second chamber positioned to another side of the collision wall, wherein the second chamber stores dust separated from air passed through the first dust collecting wall and the second dust collecting wall.

11. The cleaner according to claim 10, wherein the dust container further comprises a partition wall, the partition wall separating the first chamber from the second chamber, the partition wall connected to one edge of the collision wall.

12. The cleaner according to claim 1, wherein the dust container further comprises a cyclone unit configured to separate dust from air passed through the first dust collecting wall or the second dust collecting wall.

13. The cleaner according to claim 12, wherein:

the dust container further comprises a guide passage configured to guide air inside the dust container to a cyclone inlet of the cyclone unit; and the collision wall forms one surface of the guide passage.

14. The cleaner according to claim 1, wherein the dust container further comprises a multi cyclone unit configured to separate dust from air passed through the first dust collecting wall or the second dust collecting wall.

15. The cleaner according to claim 1, wherein the dust container further comprises an outlet configured to discharge air inside the dust container to an outside of the dust container, the outlet formed in one of a side or a bottom of the dust container.

16. A dust container detachably coupled to a main body of a cleaner, the dust container comprising:

an outer wall including a front surface with an inlet through which air and dust is introduced into the dust container;

a collision wall parallel to the front surface with the inlet, the collision wall positioned closer to the inlet than to an outer wall of the dust container;

a first dust collecting wall perpendicular to the collision wall, the first dust collecting wall configured to collect at least a part of the dust introduced through the inlet, the first dust collecting wall including a plurality of holes;

a second dust collecting wall extending from a top of the collision wall towards the front surface with the inlet and configured to collect at least a part of the dust introduced through the inlet, the second dust collecting wall perpendicular to the collision wall and the first dust collecting wall; and a bypass passage formed between the second dust collecting wall and a structure adjacent to the second dust collecting wall, the bypass passage configured to prevent a suction force of the cleaner from being lowered in response to clogging of the plurality of holes.

17. The dust container according to claim 16, wherein the bypass passage is at least one of:

a predetermined gap formed between the first dust collecting wall and a structure adjacent to the first dust collecting wall; or a predetermined gap formed between the second dust collecting wall and a structure adjacent to the second dust collecting wall.

18. The dust container according to claim 16, wherein, based on one surface of the collision wall facing the inlet being a front surface of the collision wall:

the first dust collecting wall is connected to a side edge of the collision wall; and the second dust collecting wall is connected to a top of the collision wall.

19. A cleaner comprising:

a main body comprising a suction portion;

and a dust container configured to separate and store dust from the air sucked through the suction portion, wherein the dust container comprises:

an outer wall including a front surface with an inlet through which air and dust is introduced into the dust container, the air and dust introduced;

a collision wall parallel to the front surface with the inlet, wherein a distance between the collision wall and the inlet is shorter than a length of the dust container;

a first dust collecting wall configured to collect at least a part of the dust introduced through the inlet, the first dust collecting wall perpendicular to the collision wall; and a second dust collecting wall extending from a top of the collision wall towards the front surface with the inlet and configured to collect at least a part of the dust introduced through the inlet, the second dust collecting wall perpendicular to the collision wall and the first dust collecting wall.

* * * * *